US005617792A

United States Patent [19]

Rau et al.

[11] Patent Number: 5,617,792

[45] Date of Patent: Apr. 8, 1997

[54] ROLLER ELEMENT FOR PRESSING A FLEXIBLE PRINTING PLATE ONTO THE FORM CYLINDER

[75] Inventors: Gunnar Rau, Königsbrunn; Albert Heller, Pestenacker; Michael Scholz, Münsterhausen; Georg Kaessmair, Zusamzell, all of Germany

[73] Assignee: MAN Roland Druckmaschinen AG, Offenbach am Main, Germany

[21] Appl. No.: 555,915

[22] Filed: Nov. 13, 1995

[30] Foreign Application Priority Data

Nov. 10, 1994 [DE] Germany ..... 44 40 239.2

[51] Int. Cl.[6] ..... B41F 21/00

[52] U.S. Cl. ..... 101/477; 101/415.1

[58] Field of Search ..... 101/216, 415.1, 101/477

[56] References Cited

U.S. PATENT DOCUMENTS

| | | | |
|---|---|---|---|
| 4,727,807 | 3/1988 | Suzuki et al. | 101/415.1 |
| 5,111,744 | 5/1992 | Wieland | 101/415.1 |
| 5,406,888 | 4/1995 | Sugiyama et al. | 101/477 |
| 5,495,805 | 3/1996 | Beisel et al. | 101/477 |
| 5,540,151 | 7/1996 | Ruckmann et al. | 101/477 |
| 5,555,810 | 9/1996 | Stiel | 101/477 |
| 5,558,111 | 9/1996 | Ruckmann et al. | 101/477 |

FOREIGN PATENT DOCUMENTS

| | | |
|---|---|---|
| 0433798 | 6/1991 | European Pat. Off. . |
| 0678382 | 10/1995 | European Pat. Off. . |
| 0679513 | 11/1995 | European Pat. Off. . |
| 4218602 | 3/1993 | Germany . |
| 1176558 | 12/1989 | Japan . |
| 9406630 | 3/1994 | WIPO . |

*Primary Examiner*—Eugene H. Eickholt
*Attorney, Agent, or Firm*—Cohen, Pontani, Lieberman, Pavane

[57] ABSTRACT

A roller element for pressing a flexible printing plate against a form cylinder of a printing unit in a rotary printing machine during a first mode of winding the printing plate on the form cylinder and a second mode of unwinding the printing plate from the form cylinder. The roller element has at least one winding roller, a first device for positioning the at least one winding roller against the printing plate during the first mode of winding the printing plate on the form cylinder and for moving the at least one winding roller away from and out of contact with the printing plate during the second mode of unwinding the printing plate from the cylinder, at least one unwinding roller and a second device for positioning the at least one unwinding roller against the printing plate during the second mode of unwinding the printing plate from the form cylinder and for moving the at least one unwinding roller away from and out of contact with the printing plate during the first mode of winding the printing plate on the form cylinder.

12 Claims, 4 Drawing Sheets

ROLLER ELEMENT FOR PRESSING A FLEXIBLE PRINTING PLATE ONTO THE FORM CYLINDER

BACKGROUND OF THE INVENTION

1. Field of the Invention

The invention relates to roller elements of a rotary printing machine and, more particularly, to a roller element for pressing a flexible priming plate against the form cylinder of a printing group of a rotary priming machine during a plate change.

2. Description of the Prior Art

Roller elements are well known in the art. For example, Japanese Patent Document No. 1-176558 discloses a device for mounting and removing a flexible printing plate. When the printing plate is wound onto or off the form cylinder, two rollers are used to press the printing plate against the rotating form cylinder. The rollers are separated from one another and each roller is placed into position by a working cylinder. The rollers are rotatably fastened to the piston rods of the working cylinder. This device is disadvantageous in that, during the removal of the printing plate, the rollers become smeared with ink from the inked image on the printing plate. Before a new printing plate is mounted, the rollers must be cleaned, which is a time-consuming process. If the rollers are not cleaned they will smear the new printing plate, resulting in smeared sheets at the start of the printing process and continuing until the printing plate becomes clean during the course of priming.

German Patent Document No. DE 42 18 602 C2 describes a pressing roller located on the form cylinder in a stationary manner. This device has the disadvantage that the pressing roller becomes contaminated by ink splatters and ink mist. In addition, a new printing plate is smeared with ink by the pressing roller when it is mounted.

It is thus desirable to provide a pressing roller which does not smear a printing plate with ink during mounting.

SUMMARY OF THE INVENTION

It is thus an object of the invention to provide a roller element for pressing a printing plate that does not smear the printing plate with ink during mounting.

The roller element of the present invention is separated into winding and unwinding rollers. The winding rollers are used only in mounting the printing plate and thus do not become smeared with ink during the removal of the printing plate thereby eliminating the possibility of contaminating the new printing plate. Furthermore, the roller element no longer needs to be continually washed, reducing the machine downtime, and the smearing of sheets at the beginning of the printing process is eliminated. When connected with a suitable plate clamping system, the roller element allows for a fully automatic plate change.

The roller element may also include a device for protecting the rollers and pressing elements from being contaminated by ink spatters and ink mist and eliminates the need for cleaning these elements. Even rollers that are used only for mounting a printing plate and thus arranged in a stationary manner extending across the breadth of the printing plate are no longer subject to frequent cleaning.

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there are illustrated and described preferred embodiments of the invention.

BRIEF DESCRIPTION OF THE DRAWINGS

In the drawings in which like numerals are used to denote similar elements.

DETAILED DESCRIPTION OF THE PRESENTLY PREFERRED EMBODIMENTS

Figure 1:
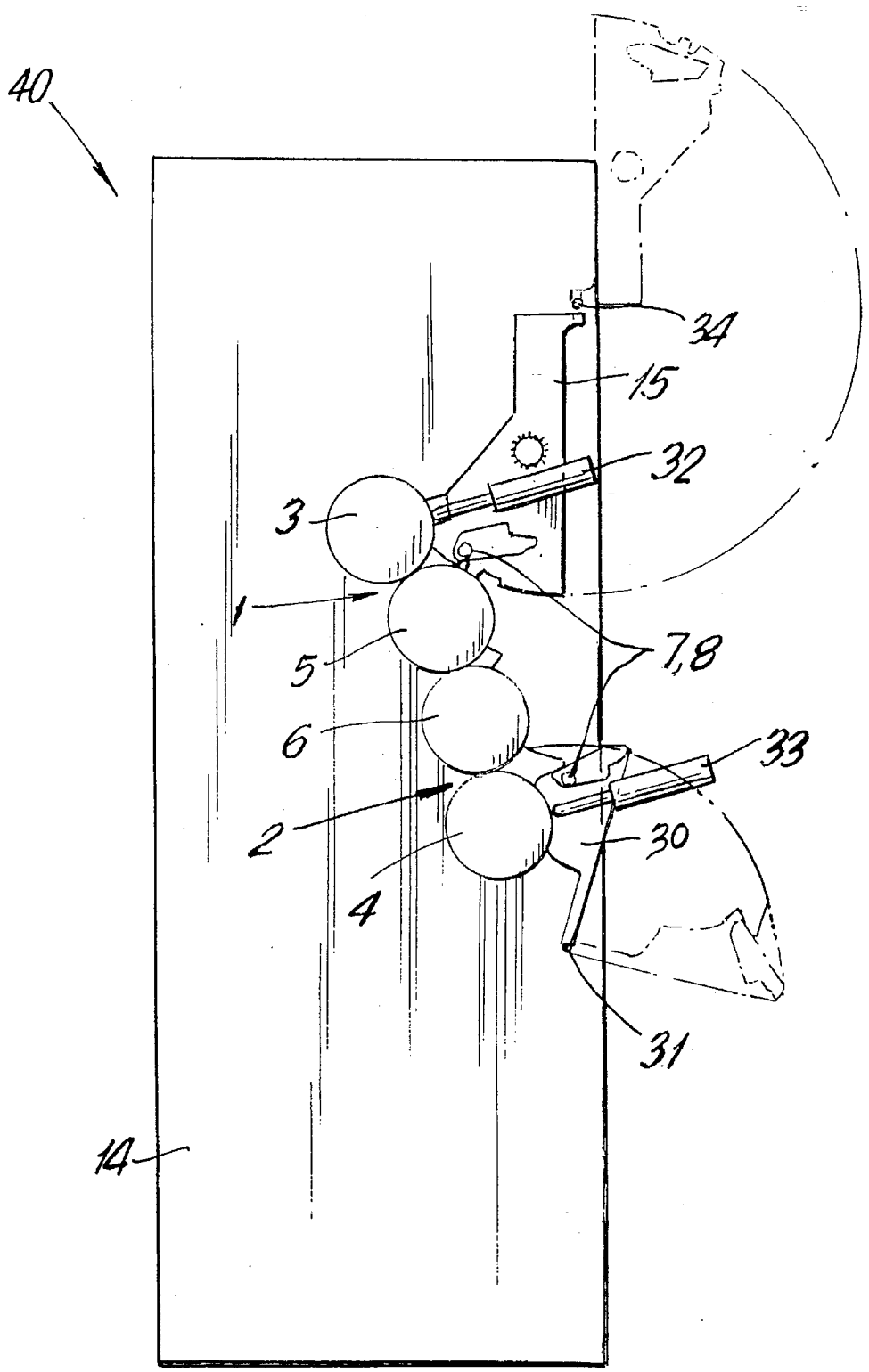
FIG. 1 is a side view of a double priming group in accordance with the present invention.
Figure 2:
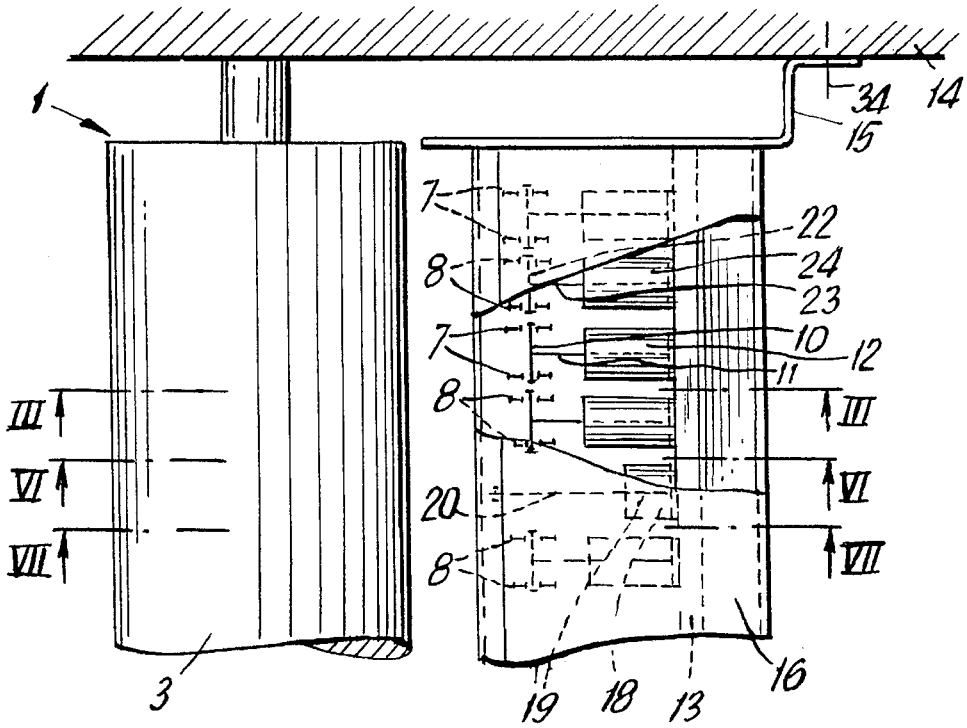
FIG. 2 is a top view of the double priming group of FIG. 1.

FIG. 1 shows a printing unit of an offset rotary printing machine in accordance with the present invention and indicated by the general reference numeral 40 having two priming groups labelled 1 and 2. Each of the printing groups 1, 2 contains a form cylinder 3, 4 and a transfer cylinder 5, 6, respectively. Roller elements in the form of winding and unwinding rollers 7, 8 are positioned adjacent the form cylinder 3 as shown in FIG. 2; the respective winding and unwinding rollers 7, 8 being arranged next to one another in alternating fashion. Two winding rollers 7 are rotatably mounted on an axle 10 attached to a piston rod 11 of a working cylinder 12. Analogous to this, the two unwinding rollers 8 are rotatably mounted on an axle 22 attached to a piston rod 23 of a working cylinder 24. The working cylinders 12 and 24 are attached to a cross piece 13, which in turn is attached to a roller protector 15 pivotally mounted in a side wall 14 of the priming group 1. When the roller protector 15 is swung about its pivot point 34 into the position shown by the dot-dashed line in FIG. 1, the winding and unwinding rollers 7, 8 are simultaneously swung away from the form cylinder 3 and the form cylinder 3 becomes easily accessible. To eliminate the option of uncovering or providing access to the form cylinder 3, the cross piece 13 may be attached directly to the side walls 14 in a stationary manner.

The winding and unwinding rollers 7, 8 have a rubber cover or other resilient cover, so that they do not damage the printing plate when positioned upon it. The design can be modified in such a way that only one roller, as applicable, a broader roller, is fastened to a piston rod 11, 23. It is also possible to use a single first roller that extends over approximately half of the printing plate, while a single second roller is positionable in the region of the other half of the printing plate.

Figure 7:
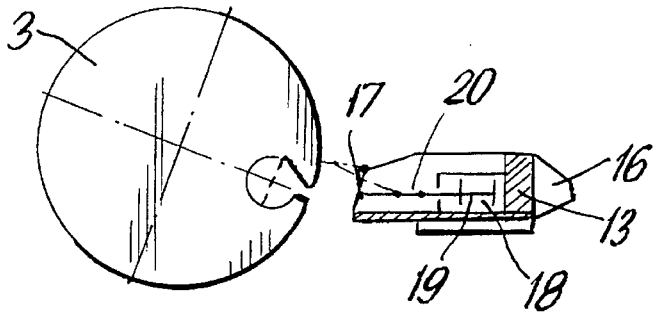
FIG. 7 is a partial cross sectional view along the line VII—VII of FIG. 2.

The winding and unwinding rollers 7 and 8 are housed, together with the working cylinders 12 and 24 and the cross piece 13 in a device for protecting the rollers from contamination 16. The protecting device 16 has a box-type design and an opening flap 17 swingable towards and away from the form cylinder 3. Attached to the protecting device 16 or, more precisely, to the cross piece 13 is a working cylinder 18, the piston rod 19 of which is connected in articulated fashion via a coupling 20 to the opening flap 17 for moving the opening flap as shown in FIG. 7 between an open and closed position.

Figure 3:
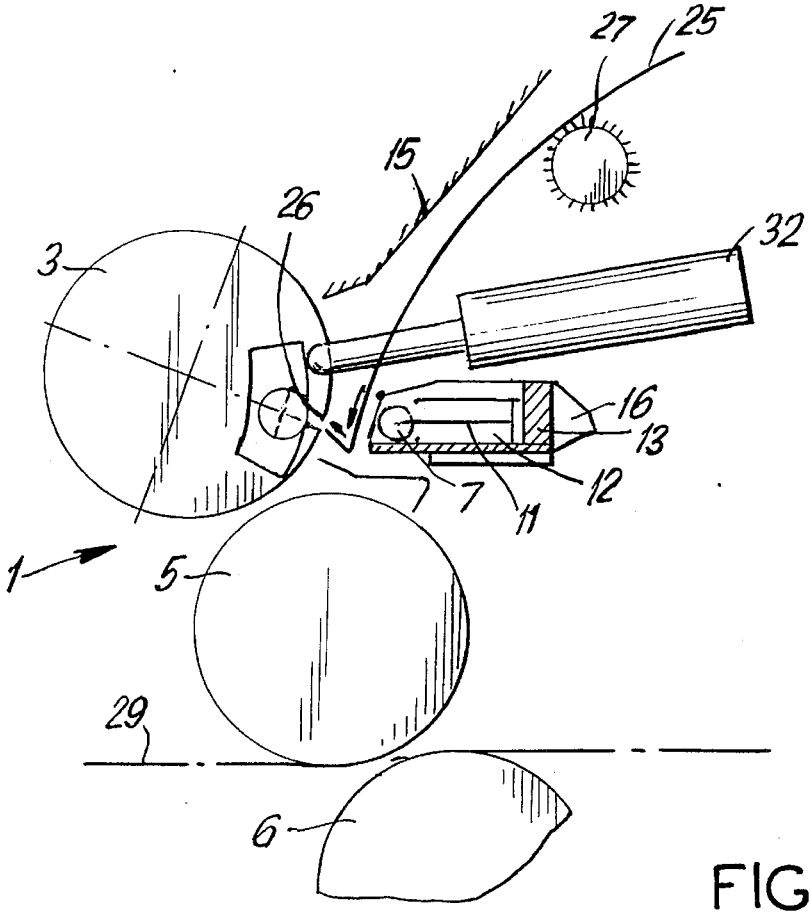
FIG. 3 is a partial cross sectional view along the line III—III of FIG. 2.
Figure 4:
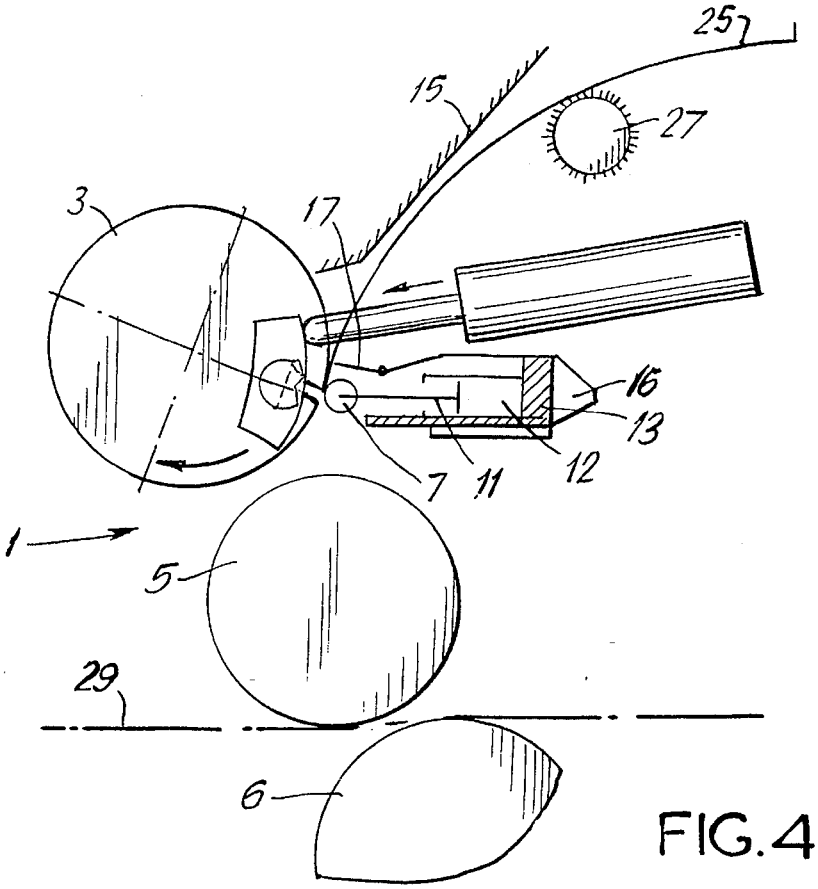
FIG. 4 is a partial cross sectional view along the line III—III of FIG. 2, having a forward edge of the printing plate clamped.
Figure 5:
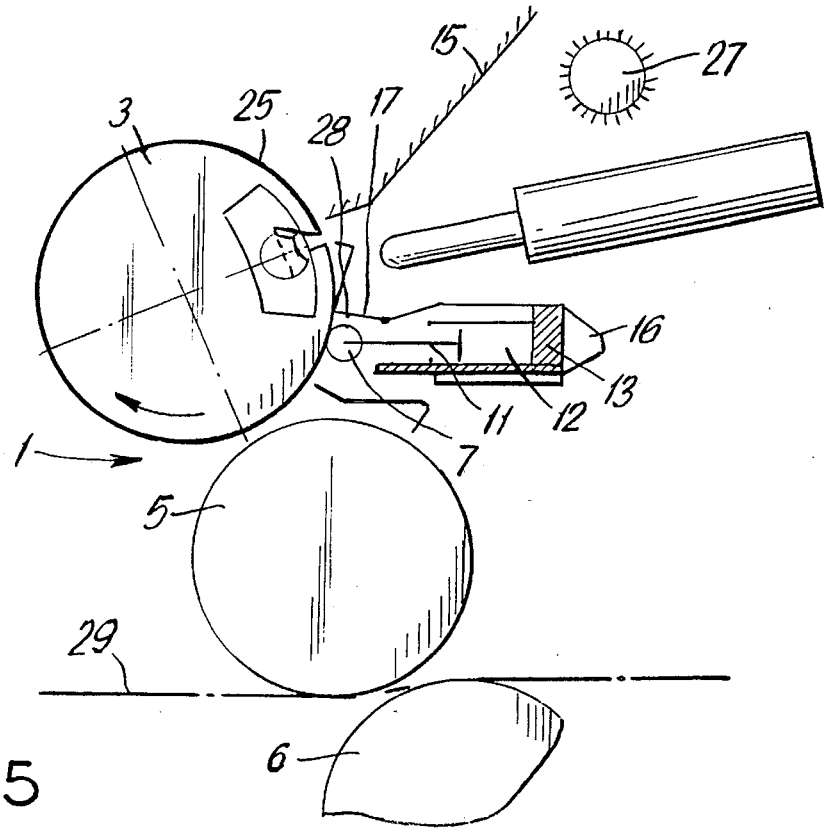
FIG. 5 is a partial cross sectional view along the line III—III of FIG. 2 during winding of the printing plate.

In order to mount the printing plate 25, the printing plate 25 is first guided by its forward end into the clamping channel 26 of the form cylinder 3 as shown in FIG. 3. The working cylinder 18 is then reversed and its piston 19 is moved outward towards the form cylinder 3. The piston 19 swings the opening flap 17 via the coupling 20 into the opened position as shown in FIG. 4 and by the dot-dashed line in FIG. .7. After this, the working cylinders 12 are reversed, causing their piston rods 11 to be moved outward and the winding rollers 7 to be positioned in contact with the form cylinder 3. The winding rollers 7 and form cylinder 3 now clamp the forward edge of the printing plate 25 therebetween. When the form cylinder 3 is subsequently turned in the direction indicated in FIGS. 4 and 5, the printing plate 25 is drawn onto the form cylinder 3. It is supported in position by a brush roller 27. In addition, a rounded roller protector 15 having a large radius prevents the trailing end of the printing plate 25 from catching. As the printing plate 25 is wound, the winding rollers 7 are in rolling contact with the printing plate 25 pressing it onto the form cylinder 3. The opening flap 17 serves as an entrance protector for the entrance gap 28 between the form cylinder 3 and the winding roller 7 and shown in FIG. 5 protecting the area at which the printing plate is pressed against the form cylinder from contamination. As the printing plate 25 is wound, it is advantageous that the transfer cylinder 5 is not positioned in contact with the form cylinder· 3. Instead, the transfer cylinder 5 is located in the printing position, so that during a plate change, i.e., during plate mounting as well as plate removal the web 29 to be printed later does not need to be cut off and remains in position between the transfer cylinders 5, 6.

Figure 6:
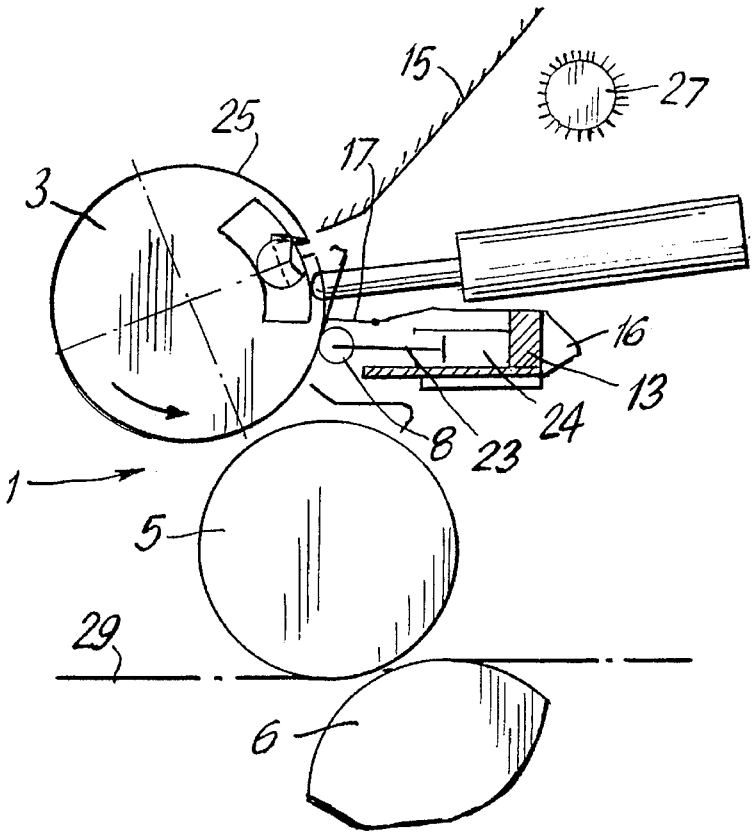
FIG. 6 is a partial cross sectional view along the line VI—VI of FIG. 2 during removal of the printing plate.

FIG. 6 illustrates the position of the elements during removal of the printing plate 25. The opening flap 17 of the contamination protector 16 is placed in the open position through suitable control of the working cylinder 18 as described previously. By reversing the working cylinders 24, their piston rods 23 are moved from the position shown in FIG. 2 into the position shown in FIG. 6, i.e. the piston rods 23 are moved out towards the form cylinder 3 causing the unwinding rollers 8 to move towards the form cylinder 3 and supply the form cylinder 3 with unwinding contact during the unwinding of the printing plate 25. In this position, the winding rollers 7 are separated from the form cylinder 3. It is therefore only the unwinding rollers 8 that come into contact with the inked priming plate 25 being removed and that become contaminated with ink. The clean winding rollers 7 are thus available for mounting a new, clean printing plate 25 without the need for cleaning as they did not contact the printing plate being removed and thus are not smudged.

A further rolling element including winding and unwinding rollers 7, 8 is positioned adjacent the form cylinder 4 of the lower printing group 2 as shown in FIG. 1. The rollers 7, 8 are attached to a roller protector 30, which is pivotally mounted about a pivot point 31 in the side wall 14. This permits the winding and unwinding rollers 7, 8 to be swung together with the roller protector 30 about the pivot point 31 and away from the form cylinder 4 as shown by the dot-dashed line of FIG. 1.

The working cylinders 12, 18 and 24 may be advantageously operated using compressed air. The amount of compressed air used to operate the working cylinder 18 is limited with respect to pressure so that the opening flap 17 can be safely operated and will not cause injury to the hands of an operator due to uncontrolled opening or closing.

The priming unit may also include a plate clamping system for clamping the form cylinders 3, 4, along with the associated operating elements 32, 33.

The invention is not limited by the embodiments described above which are presented as examples only but can be modified in various ways within the scope of protection defined by the appended patent claims.

We claim:

1. A roller element for pressing a flexible printing plate against a form cylinder of a printing unit in a rotary printing machine during a first mode of winding the printing plate on the form cylinder and a second mode of unwinding the priming plate from the form cylinder, the roller element comprising:

at least one winding roller;

first means for positioning said at least one winding roller against the printing plate during said first mode of winding the printing plate on the form cylinder and for moving the at least one winding roller away from and out of contact with the printing plate during said second mode of unwinding the printing plate from the cylinder;

at least one unwinding roller separate from said at least one winding roller; and second means for positioning said at least one unwinding roller against the printing plate during said second mode of unwinding the printing plate from the form cylinder and for moving said at least one unwinding roller away from and out of contact with the printing plate during said first mode of winding the printing plate on the form cylinder.

2. The roller element of claim 1, further comprising a plurality of winding rollers and a plurality of unwinding rollers positioned in alternating fashion along a length of the form cylinder.

3. The roller element of claim 1, wherein the means for positioning said at least one winding roller includes a working cylinder, an axle and a piston rod connected between said working cylinder and axle, said at least one winding roller being rotatably mounted to said axle.

4. The roller element of claim 3, further comprising a second winding roller rotatably mounted to said axle.

5. The roller element of claim 1, wherein said means for positioning said at least one unwinding roller includes a working cylinder, an axle and a piston rod connected between said working cylinder and axle, said at least one unwinding roller being rotatably mounted to said axle.

6. The roller element of claim 5, further comprising a second unwinding roller rotatably mounted to said axle.

7. The roller element of claim 3, wherein the printing unit includes a side wall and said roller element further comprises a roller protector pivotally mounted to the side wall; and a cross piece connected to said roller protector, said working cylinder being positioned on said cross piece.

8. The roller element of claim 5, wherein the printing unit further includes a side wall and said roller element further comprises a roller protector pivotally mounted to the side wall; and a cross piece connected to said roller protector, said working cylinder being positioned on said cross piece.

9. The roller element of claim 1, further comprising means for protecting said at least one winding roller and said at least one unwinding roller from contamination, said at least one winding roller and at least one unwinding roller being positioned within said means for protecting and said means for protecting being movable between a first position in which one of said at least one winding and at least one unwinding rollers is positionable against the outer surface of the form cylinder and a second position in which both said winding and unwinding rollers are separated from the form cylinder.

10. The roller element of claim 9, wherein said means for protecting is box shaped and includes a swingable flap movable between an open position allowing one of said at least one winding and at least one unwinding rollers to be positioned against the outer surface and a closed position in which said at least one winding and at least one unwinding rollers are prevented from contacting the form cylinder.

11. The roller element of claim 10, further comprising a working cylinder and a piston rod connected between said working cylinder and said opening flap for moving said opening flap between said open and closed positions.

12. The roller element of claim 10, wherein said first and second means for positioning create an entrance gap during said first and second modes, respectively, said opening flap protecting the entrance gap in said open position.

* * * * *